United States Patent [19]

Decobert

[11] 4,056,230

[45] Nov. 1, 1977

[54] METHOD OF CRUSHING PARTICLES OF MATERIAL IN A BALL MILL

[75] Inventor: Jacques L. E. Decobert, Les Candeaux Eysus, France

[73] Assignee: Alcan Research and Development Limited, Montreal, Canada

[21] Appl. No.: 633,409

[22] Filed: Nov. 19, 1975

[30] Foreign Application Priority Data

Nov. 20, 1974 France ..... 74.38134

[51] Int. Cl.[2] ..... B02C 23/18

[52] U.S. Cl. ..... 241/15; 241/30; 241/80; 241/171

[58] Field of Search ..... 241/15, 30, 79, 79.2, 241/79.3, 137, 80, 171

[56] References Cited

U.S. PATENT DOCUMENTS

| | | | |
|---|---|---|---|
| 1,058,953 | 4/1913 | Easton | 241/79.3 |
| 1,313,734 | 8/1919 | Randall | 241/79 |
| 1,368,739 | 2/1921 | Lindhard | 241/80 |
| 1,513,952 | 11/1924 | Apted | 241/137 |
| 1,914,184 | 6/1933 | Traquair | 241/30 |
| 2,002,891 | 5/1935 | Hall | 241/15 |
| 2,332,701 | 10/1943 | Dowsett | 241/171 |
| 3,180,581 | 4/1965 | Velcheff | 241/79 |
| 3,206,128 | 9/1965 | MacPhersen et al. | 241/137 |
| 3,709,439 | 1/1973 | Tundermann et al. | 241/15 |
| 3,894,692 | 7/1975 | Sanko et al. | 241/30 |
| Re. 20,941 | 12/1938 | Slade | 241/137 |

*Primary Examiner*—Granville Y. Custer, Jr.
*Attorney, Agent, or Firm*—Cooper, Dunham, Clark, Griffin & Moran

[57] ABSTRACT

A method of crushing particles of material in a ball mill comprises feeding a mixture of balls and a charge comprising the particles to be crushed, a solvent and a lubricant continuously through a ball mill which initially contains balls. The balls are recovered from the mixture issuing from the mill and are re-introduced into the mill with a fresh charge. One form of apparatus for carrying out the method comprises a cylindrical container disposed with its axis horizontal and rotatable about said axis. The inlet and outlet of the mill are arranged centrally at opposite ends of the container, and the outlet leads to an annular sieve which rotates with and is coaxial with the container. The sieve retains the balls for return to the inlet and allows the milled charge to fall into a receptacle. In an alternative form of the apparatus, the container has inlets at both ends and has an outlet with an associated sieve at its mid-length.

5 Claims, 4 Drawing Figures

METHOD OF CRUSHING PARTICLES OF MATERIAL IN A BALL MILL

Figure 1:
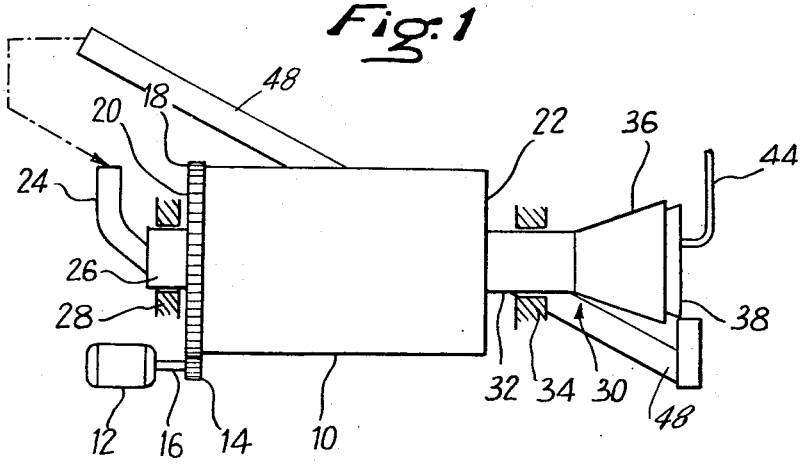

The invention relates to a method of crushing particles of material and to an improved ball-mill for carrying out the method.

The crushing of particles of material, particularly metallic particles for the purpose of preparing metallic pigments, is usually carried out in a ball-mill. Such crushing mill comprises a horizontal cylindrical container which is caused to rotate about its own axis; the container may be fitted with internal liftable partitions, and between 25 and 45% of its volume is filled with balls.

This crushing may be carried out dry in a controlled atmosphere and in the presence of a lubricant. It is then possible to move the particles along in a stream of circulating gas during the crushing operation, to grade the particles by size in a continuous manner, to extract the crushed particles at the required size, and to reintroduce particles that are too large into the interior of the crushing mill. This procedure avoids the formation of excessively fine particles which have a deleterious effect upon the quality of the pigment obtained, but the procedure suffers from disadvantages due to the use of an inert gas.

To avoid these disadvantages, the tendency has been to abandon dry crushing in the presence of a solvent. However, the generally pasty nature of the three-part mixture of the metal, the lubricant and the solvent, makes it impossible to grade the particles continuously as a function of the stage reached in their transformation. In this method certain particles are crushed to too great an extent if it is desired to reduce the largest particles to the required size. Certain measures have been used with a view to removing this difficulty and these may consist in carrying out crushing in a continuous stream of solvent which is used to introduce the particles to be crushed into the mill, for extracting them and for directing them towards a screen. The large particles are then reintroduced into and passed through the mill, but the presence of excess liquid in the mill has a deleterious effect upon the efficiency of the crushing operation, and in the particular case of the preparation of aluminium pigments, the excess liquid prevents certain reactions from taking place and this may cause the outbreak of fire at a later stage.

Efforts to avoid the above-mentioned drawbacks have led to operation on a discontinuous basis, namely to crushing during relatively short periods, extraction of the crushed mixture by flushing, and reintroducing of a relatively dry mixture into the crushing mill. This mode of operation involves idling periods of substantially constant length which are independent of the other operations but which assume a relatively great importance depending upon the duration of the crushing sequences required to obtain a uniform particle-size.

According to this invention in one aspect there is provided a method of crushing particles of material in a ball-mill, in which method a mixture composed of balls and of a charge consisting of the particles to be crushed, a solvent and a lubricant is continuously introduced into a ball-mill initially containing a quantity of balls, a mixture of balls, crushed particles, solvent and lubricant being continuously recovered at the outlet from the mill, and the balls being separated from the recovered mixture and reintorduced into the mill with a fresh charge.

The invention also provides a ball-mill for carrying out the method set out in the preceding paragraph, comprising a horizontal cylindrical container which is adapted to be rotated about its own axis by means of a motor and which is provided with a feed opening formed at the centre of one of its ends, and with a discharge opening formed at the centre of its opposite end, a continuous discharge means secured to the container for rotation therewith and comprising a horizontal cylindrical duct into one end of which the discharge opening of the container opens and the other end of which opens into a frusto-conical sieve surrounded by a frusto-conical funnel-like receptacle which is radially spaced from said sieve, the duct, sieve and receptacle being mounted coaxially with the container.

The invention further provides a ball-mill for carrying out the said method, comprising a horizontal cylindrical container which is adapted to be rotated about its own axis by means of a motor and which is provided with two feed openings, formed respectively at the centre of the ends of the container, and with at least one discharge opening formed at the periphery of the container, a fixed channel, encircling the container where the peripheral opening or openings is or are located and having an outlet disposed below the container, the discharge openings being of such size as to afford passage to the balls and the charge following the crushing operation, and the opening in the channel being provided with a sieve for separating the balls from the rest of the mixture.

The invention will be explained in detail in the following description which refers to the annexed drawings showing two forms of construction of a ball-mill according to the invention. In the drawings FIG. 1 is a general view of a first form of construction of a ball-mill in accordance with the invention, FIG. 2 is a perspective view showing the discharge end of the mill illustrated in FIG. 1, with parts cut away to show the construction, FIG. 3 is a view in axial section through the mill of FIG. 2, and FIG. 4 is a general view of a second form of construction of a ball-mill in accordance with the invention.

The crushing mill illustrated in FIG. 1 comprises a horizontal cylindrical container 10 adapted to be rotated about its own axis by means of a motor 12 driving a pinion 14 which is mounted on the shaft 16 of this motor and which meshes with a toothed ring 18 fixed to the container 10. The container 10 has a charging opening formed at the centre of its end 20, and a discharge opening formed at the centre of its opposite end 22. The mixture to be crushed is introduced into the container through a duct 24 which runs into a cylindrical part 26 secured to the container and supported by a bearing 28. The ball-mill has a continuous discharge means 30 fixed to the container. Discharge means 30 comprises a cylindrical duct 32 supported by a bearing 34, one end of this duct opening from the container 10, and a frusto-conical funnel-like receptacle 36 coaxially within which is mounted a frusto-conical sieve 38. Material discharged from container 10 is passed along the duct 32 and falls into the sieve 38. The receptacle 36 surrounds and is radially spaced from sieve 38.

Figure 2:
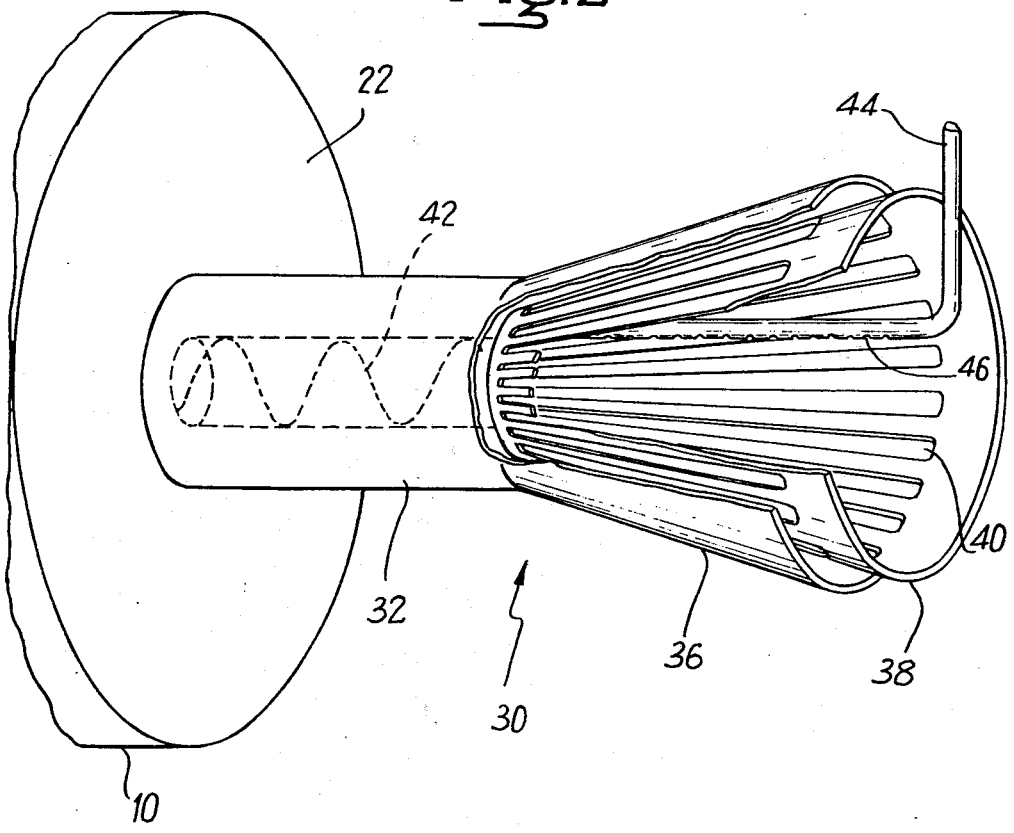
Figure 3:
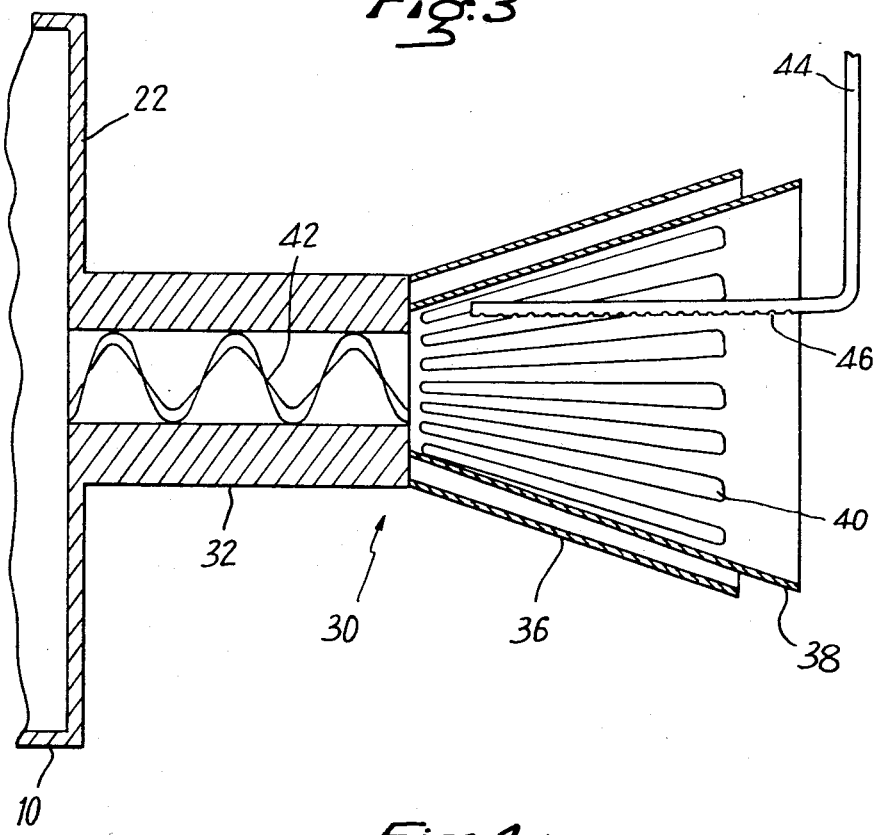
Figure 4:
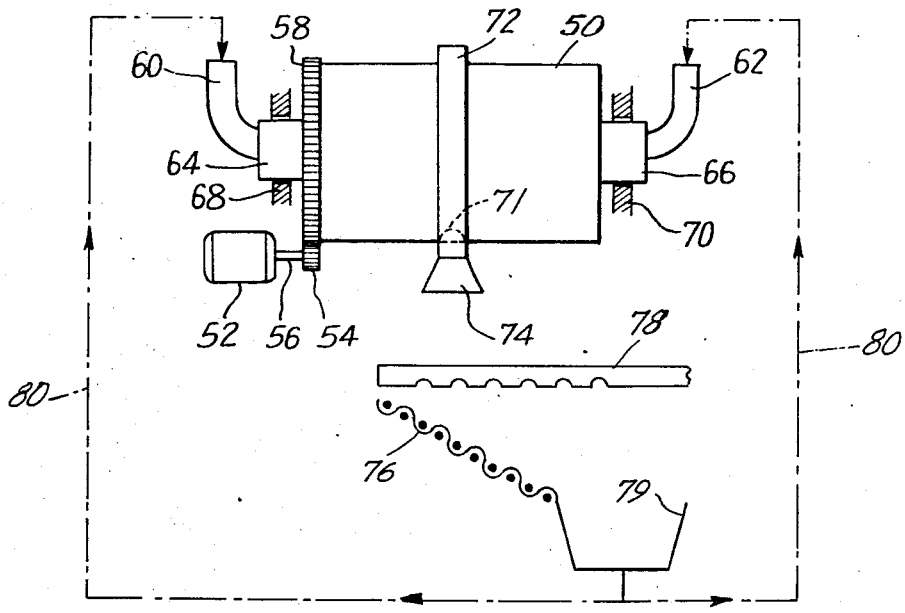

As can be seen from FIGS. 2 and 3, the frusto-conical sieve 38 has a plurality of elongated slots 40 extending along generatrices of the sieve, the width of each of these slots being less than the size of the balls so that the latter can be separated from the rest of the mixture discharged from container 10. The duct 32 is provided with a screw 42, for example an Archimedean screw which is of the same length as the duct and is mounted within it, so that when the container is rotated the mixture is fed towards the sieve 38.

The provision of such a screw is not essential but is preferable to ensure steady discharge of the mixture after it has been crushed.

The crushing mill also includes a washing means formed by a pipe 44 provided with a plurality of orifices 46 for spraying solvent on to the mixture as it arrives in the sieve 38.

The crushing mill is used in the following manner. A mixture consisting of balls and of a charge, composed of the particles to be crushed and of a solvent and a lubricant, is continuously introduced into the mill which is initially filled with balls. The quantity of balls initially put into the container should exceed one-half of the interior volume of the latter so as to enable the mixture to be discharged through the discharge opening of the container. The content of non-volatile substances in the charge is generally within the range 20 to 80% by weight. The balls may be made of stainless steel for example, as currently used in this type of crushing mill.

As the container rotates, the mixture is discharged from it through the duct 32 and runs into the frusto-conical sieve 38 where it is sprayed with solvent by the washing means. The frusto-conical sieve separates the balls from the rest of the mixture, and this remainder passes through the slots in the sieve into the space between the sieve 38 and the receptacle 36. The balls separated in this way are carried away by means of a suitable conveyor 48 and are reintroduced into the crushing mill with a fresh discharge of particles, solvent and lubricant. The rest of the mixture may then be fed towards various screens in known manner so as to obtain the required particlesize.

Excessively large particles separated in this way can be crushed again either in the same crushing mill or in a second similar ball-mill where the composition of the new mixture so introduced is adapted to the new size of the particles which are introduced.

The crushing mill illustrated in FIG. 4 comprises a horizontal cylindrical container 50 adapted to be rotated about its own axis by means of a motor 52 driving a pinion 54 which is mounted on the shaft 56 of the motor which meshes with a toothed ring 58 fixed to the container 50. The container has two feed openings respectively formed at opposite ends of the container. The feed is conveyed into the container through two ducts 60 and 62 which open respectively into two cylindrical elements 64 and 66 supported by bearings 68 and 70 respectively.

The mixture is discharged through at least one discharge opening 71, formed on the periphery of the container. The mixture so discharged is collected in a fixed channel 72 which encircles the container where the discharge opening or openings is or are located and which has an outlet 74 in its lower portion, that is to say below the container 50. The discharge opening or openings is or are of such size as to afford passage to the charge and the balls after the crushing operation has been carried out, and the outlet of the channel is provided with a sieve 76, below the outlet 74, for separating the balls from the rest of the mixture. At the sieve 76 the mixture is sprayed with solvent with the aid of a spray washing means 78 so as to enable the rest of the mixture to be collected separately through and below the sieve 76, and to cause it to pass through the screens in the conventional manner. The balls collected on the sieve 76 in this way are received by a hopper 79 and carried by conveyors schematically indicated at 80 so as to be reintroduced into the container with a fresh charge by way of the ducts 60 and 62. Excessively large particles separated in this way can be reintroduced either into the same crushing mill or into another mill where the composition of the mixture is adapted to suit the new particle-size.

The above-described methods enable the crushing of particles of material, particularly metallic particles, to be carried out on a continuous basis in the presence of a lubricant and a solvent in proportions such that the content of non-volatile substances in the charge is raised to a relatively high level (up to 80%), with continuous extraction of this mixture for the purpose of grading it on a continuous basis outside the crushing mill.

The method of crushing and the ball-mill in accordance with the invention can be used for treating various types of particles of material and especially for the crushing of metallic particles for the manufacture of metallic pigments.

I claim:

1. A continuous method of crushing metal particles in a ball-mill to produce metallic pigment, in which method: a mixture composed of balls and of a charge consisting of the metal particles to be crushed, a solvent and a lubricant is continuously introduced into a ball mill initially containing a quantity of balls; a mixture consisting of balls, crushed metal particles, solvent and lubricant being continuously recovered at the outlet from the mill; and the balls being separated from the recovered mixture by washing with solvent and reintroduced into the mill with a fresh charge, while the crushed metal particles with solvent are delivered separately from the balls; the content of non-volatile substances in the charge being between 20% and 80% by weight.

2. A method according to claim 1, wherein the quantity of balls initially put into the crushing mill exceeds one-half of the volume of the latter.

3. A method according to claim 1, wherein the delivered crushed metal particles above a predetermined size are reintroduced into the ball-mill.

4. A method according to claim 1, wherein the delivered crushed metal particles above a predetermined size are introduced into a second ball-mill.

5. A ball-mill comprising a horizontal cylindrical container which is adapted to be rotated about its own axis by means of a motor, which is provided with two feed openings formed respectively at the centres of the ends of the container and with at least one discharge opening formed at the periphery of the container, a fixed channel encircling the container where the peripheral opening or openings is or are located and having an outlet disposed below the container, the discharge openings being of such size as to afford passage to the balls and the charge following the crushing operation, and a sieve in the opening in the channel for separating the balls from the rest of the mixture, said ball-mill further comprising a washing means adapted to inject solvent into the sieve, and conveyor means for continuously returning the balls which are separated on the sieve, to the two feed openings.

* * * * *